US005298373A

United States Patent [19]

Sasaoka et al.

[11] Patent Number: 5,298,373

[45] Date of Patent: Mar. 29, 1994

[54] PROCESS AND COMPOSITION FOR FIXING BLACK-AND-WHITE SILVER HALIDE PHOTOGRAPHIC MATERIALS

[75] Inventors: Senzo Sasaoka; Katsumi Hayashi; Kota Fukui; Tetsuro Kojima, all of Kanagawa, Japan

[73] Assignee: Fuji Photo Film Co., Ltd., Kanagawa, Japan

[21] Appl. No.: 803,039

[22] Filed: Dec. 6, 1991

[30] Foreign Application Priority Data

Dec. 6, 1990 [JP] Japan ..... 2-405345
May 21, 1991 [JP] Japan ..... 3-144226

[51] Int. Cl.[5] ..... G03C 5/18; G03C 5/26; G03C 5/38; G03C 1/76

[52] U.S. Cl. ..... 430/429; 430/428; 430/455; 430/459; 430/533; 430/939

[58] Field of Search ..... 430/428, 429, 455, 459, 430/533, 939

[56] References Cited

U.S. PATENT DOCUMENTS 4,378,424 3/1983 Atland et al. ..... 430/455
4,861,702 8/1989 Suzuki et al. ..... 430/967
4,939,075 7/1990 Bergthaller et al. ..... 430/460
5,026,629 6/1991 McGuckin et al. ..... 430/455
5,066,569 11/1991 Nagashima et al. ..... 430/455

FOREIGN PATENT DOCUMENTS 0431568 12/1991 European Pat. Off. ..... 430/455

OTHER PUBLICATIONS

U.S. Statutory Invention Registration H953, Goto et al., Aug. 1991, class 430, subclass 429.
Research Disclosure 20430, Apr. 1981, pp. 159-160.

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

Silver halide black-and-white photosensitive material is processed with a fixer which contains 0.5 to 2.0 mol/-liter of a thiosulfate and 0.003 to 0.3 mol/liter of a meso-ionic compound, the moles of the meso-ionic compound divided by the moles of the thiosulfate being from 0.003 to 0.2. The fixer accelerates fixing speed, enabling rapid processing of photographic material.

10 Claims, 2 Drawing Sheets

PROCESS AND COMPOSITION FOR FIXING BLACK-AND-WHITE SILVER HALIDE PHOTOGRAPHIC MATERIALS

This invention relates to a method for processing photographic silver halide photosensitive material, and more particularly, to fixing treatment adapted for rapid processing of black-and-white silver halide photosensitive material.

BACKGROUND OF THE INVENTION

In the graphic printing and plate-making art, the demand for reduced processing time is increasing recently for achieving the commercial benefits of short delivery and effective working. A fixing time of up to 19 seconds is desired in order to provide an overall processing time of 60 seconds or less. In processing photosensitive materials of large size used in the graphic plate-making art such as scanner film, contact lith film, and facsimile film, however, a fixing time of up to 19 seconds will lead to short fixation, particularly at the center of the photosensitive material. Also a correspondingly reduced washing time can lead to short washing, adversely affecting image retention.

One possible approach is to reduce the amount of silver halide in photosensitive material, but is generally accompanied by a lowering of maximum density. In the graphic printing photosensitive material application where reducing treatment may be carried out, a silver amount of at least 2.0 g/m$^2$ is preferred, that is, the silver amount cannot be reduced below a certain limit.

Conventional approaches for improving fixing speed include an increase of fixing temperature and increased agitation in the fixing tank which both often suffer from local fixing marks. In extreme cases, for example, increased fixing temperatures will cause liquid evaporation, giving off smell, and evaporated sulfide gas will attack the surrounding equipment in the room.

Another approach is to increase the amount of fixer circulated through the fixing tank. Enhanced circulation provides increased fixing ability in proximity to the solution inlet and outlet of the tank, but is less effective near the center. Effective fixation near the tank center is achieved only by considerably increasing the amount of fixer circulated, but excessive fixation then takes place in proximity to the inlet and outlet, resulting in a waste of energy.

From the standpoint of fixer composition, a common approach for increasing the fixing speed is to increase the concentration of a fixing agent, typically thiosulfate. This approach, however, was impractical because of the following limitations. (a) Fixation is rather retarded when the thiosulfate concentration exceeds 2 mol/liter. (b) Since the washing time is short due to rapid processing, a higher fixing agent concentration would lower washing efficiency, resulting in a larger amount of residual hypo and poor image retention. (c) The fixer and wash water add to the environmental pollution load. (d) Concentration of the fixer is difficult and requires an increased cost.

It was also proposed to substitute organic compounds for the thiosulfates as the fixing agent. One fixing agent to substitute for the thiosulfates is a meso-ionic compound, 1,2,4-triazolium-3-thiolate as disclosed in U.S. Pat. No. 4,378,424 and Japanese Patent Application Unexamined Publication (JP-A) No. 150842/1982 wherein only an embodiment using a fixing agent consisting solely of a meso-ionic compound is described.

JP-A 201659/1989 discloses to add meso-ionic thiolate compounds to bleaching or bleach-fixing bath as a bleaching promoter; and JP-A 44355/1990 discloses the use of a bleaching solution containing ferric diethylenetriamine pentaacetate and a fixer containing a 1,2,4-triazolium-3-thiolate in the processing of color photosensitive material. However, none of these references teach the use of meso-ionic compounds in a fixer for the rapid processing of black-and-white silver halide photosensitive material (without using a bleaching solution) as proposed in the present invention and the benefits associated therewith.

Additionally, meso-ionic compounds are disclosed in U.S. Pat. Nos. 4,003,910, 4,624,913, 4,631,253, and 4,675,276, and JP-A 144737/1985, 176920/1986, 96943/1987, 217237/1987, 253161/1987, 287239/1987, 3641/1989, and 154056/1989 wherein the meso-ionic compounds are added to either photographic photosensitive materials or developers. None of these references teach the use of meso-ionic compounds in a fixer as proposed in the present invention and the benefits associated therewith.

SUMMARY OF THE INVENTION

An object of the present invention is to provide a method for rapidly processing photographic silver halide photosensitive material. Another object of the present invention is to provide a fixing solution having improved fixing ability even in the case of rapid processing.

The above and other objects are achieved according to the present invention by processing a silver halide black-and-white photosensitive material with a fixer solution, which contains 0.5 to 2.0 mol/liter of a thiosulfate and 0.003 to 0.3 mol/liter of a meso-ionic compound of general formula (I):

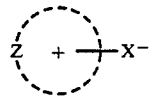

(I)

wherein Z is a five or six-membered ring composed of atoms selected from the group consisting of carbon, nitrogen, oxygen, sulfur, and selenium atoms, and $X^-$ is $—O^-$, $—S^-$ or $—NR^-$, wherein R is selected from the group consisting of an alkyl, cycloalkyl, alkenyl, alkynyl, aralkyl, aryl, and heterocyclic group, the moles of the compound of formula (I) divided by the moles of the thiosulfate being from 0.003 to 0.2.

Although the meso-ionic compounds of formula (I) can act as a solvent for silver halides and serve for fixation even when used alone, complex salts of silver with meso-ions undergo slow diffusion in the emulsion layer as compared with complex salts of silver with thiosulfate ions, and thus undesirably remain as residual silver in the emulsion layer in the case of rapid processing. Further, meso-ionic compounds when used alone are inferior in fixation to thiosulfates since the former have a longer clearing time in fixation (the time taken until photosensitive material becomes clear in the fixer) than the latter. Quite unexpectedly, the inventors have discovered that an increased fixing speed is achieved by using a meso-ionic compound and a thiosulfate in a specific ratio. More particularly, by substituting a meso-ionic compound for part of a thiosulfate in a fixer, there is obtained a fixer containing the meso-ionic compound combined with the thiosulfate which provides an outstandingly higher fixing speed than the fixer containing the thiosulfate alone, provided that both the fixers have an identical total molar concentration of fixing agent.

The moles of the compound of formula (I) divided by the moles of the thiosulfate should range from 0.003 to 0.2, preferably from 0.01 to 0.15. With a proportion of less than 0.003 or more than 0.2, the fixing speed is equal to or lower than the fixing speed achieved where the entire amount of fixing agent consists of a thiosulfate.

In the practice of the present invention, more rapid fixation can be achieved by implementing the following means in addition to the use of the above-defined fixer.

For the purpose of improving the fixation performance of a fixer in selected temperature and time conditions, it is effective to increase the amount of the fixer circulated relative to the emulsion surface of photosensitive material. In an attempt to increase the relative circulation amount of the fixer, merely increasing the amount of liquid circulated results in a degree of agitation locally varying in the moving direction of the photosensitive material. To provide enhanced agitation over the entire emulsion surface, the photosensitive material itself should be passed through the fixer at a higher speed. In this regard, there exist optimum values for the fixer flow velocity, circulation volume, and line speed. Particularly, optimum results are obtained with a fixer flow velocity of 50 to 200 m/min, a fixer circulation volume corresponding to 70 to 200% of the volume of the fixing tank, and a line speed of at least 15 mm/sec.

The amount of fixer agitated over the emulsion surface can be increased by physically removing the surface liquid film, particularly when the photosensitive material is of large size. The surface liquid film is physically removed most efficiently by opposed roller type treatment, typically by implementing three to ten pairs of opposed rollers in the fixing tank. Less than three pairs of opposed rollers would be ineffective for surface liquid film removal whereas more than ten pairs of opposed rollers would increase liquid film removal no more, require a larger size of fixing tank for accommodation, and provide a larger driving load.

The combined use of a meso-ionic compound of formula (I) and a thiosulfate as the fixing agent according to the invention allows for rapid processing without increasing the total concentration of fixing agent.

The processing time can be reduced by increasing the transfer speed of the automatic processor, but with the problems of short fixation, short drying and Dmax lowering. It was well known and commonly practiced to add a water-soluble aluminum compound to the fixer for the purposes of hardening the film surface of photosensitive material for effective drying. Since the water-soluble aluminum compound, however, retarded the fixing speed due to its film hardening action, it was difficult to find a compromise between drying and fixation. In order for the water-soluble aluminum compound to stably remain in the fixer, the fixer should have lower pH at which acetic acid and $SO_2$ gases would evolve, imposing the problems of smell and corrosion of the processor.

It is undesirable that a fixer containing a meso-ionic compound is at lower pH because as its concentrate is aged, sulfur will liberate and form a precipitate (sulfide).

Making investigations to find a compromise between drying and fixation abilities in rapid processing of photosensitive material using a fixer containing a little or no water-soluble aluminum compound, we have found that such a requirement can be met when the photosensitive material has disposed adjacent an emulsion layer a protective layer which contains up to 1.0 g/m$^2$ of gelatin. Preferably, the coverage of silver (expressed in g/m$^2$) divided by the swollen thickness (expressed in $\mu$m) is in the range of from 0.6 to 1.5. The term "swollen thickness" is used herein with respect to an overall coating on the emulsion layer side of photosensitive material and defined as the thickness of the coating wetted with water minus the thickness of the dry coating both at 25° C. A ratio of silver coverage to swollen thickness of less than 0.6 would lead to short drying whereas a ratio of more than 1.5 would lead to short fixation.

In preferred embodiments, the weight of gelatin coated in the protective layer ranges from 0.2 to 1.0 g/m$^2$, more preferably from 0.3 to 0.7 g/m$^2$, the silver coverage ranges from 2.0 to 4.0 g/m$^2$, the swollen thickness ranges from 1.5 to 6.5 $\mu$m, and the silver coverage divided by swollen thickness ranges from 0.7 to 1.3. A fixer containing a little or no water-soluble aluminum compound, more specifically 0 to 0.01 mol/liter of a water-soluble aluminum compound, can be set at a relatively high pH level of 5.3 to 7.0, eliminating the smell and corrosion problems inherently associated with conventional fixers while allowing for an increased fixing speed.

BRIEF DESCRIPTION OF THE DRAWINGS

The above and other features and advantages of the invention will be apparent from the following description of the preferred embodiments, taken in conjunction with the accompanying drawings.

DETAILED DESCRIPTION OF THE INVENTION

Generally, silver halide black-and-white photosensitive material is processed through the steps of development, fixation, washing, and drying. A developer, fixer, and water or stabilizer are used in the development, fixation, and washing steps, respectively.

Figure 1:
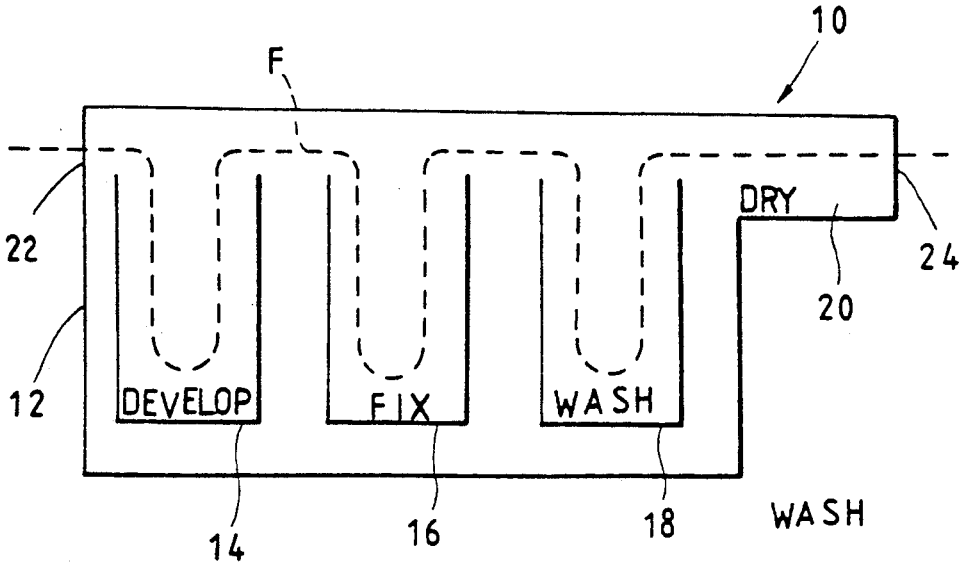
FIG. 1 is a schematic illustration of an automatic processor used in the method of the invention.

Referring to FIG. 1, there is illustrated an exemplary automatic processor used in the practice of the invention. The processor 10 includes a housing 12 in which a developing tank 14, a fixing tank 16, a washing tank 18, and a drying section 20 are accommodated in a side-by-side relationship. In the processor housing 12 is defined a continuous path for a length or discrete sheets of photosensitive material designated by F. The path (F) extends through the processor from an entrance 22 to an exit 24 in a serpentine manner so that the photosensitive material may successively pass through the developing tank 14, fixing tank 16, washing tank 18, and drying section 20 as it travels forward along the path.

Figure 2:
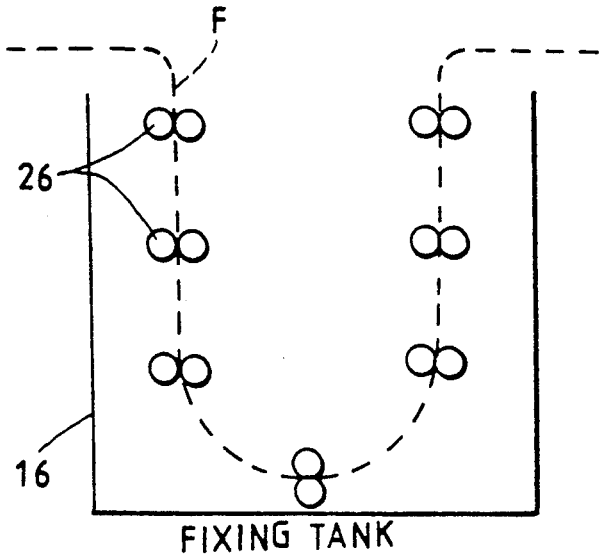
FIG. 2 is a schematic elevation of the fixing tank in the processor of FIG. 1.
Figure 3:
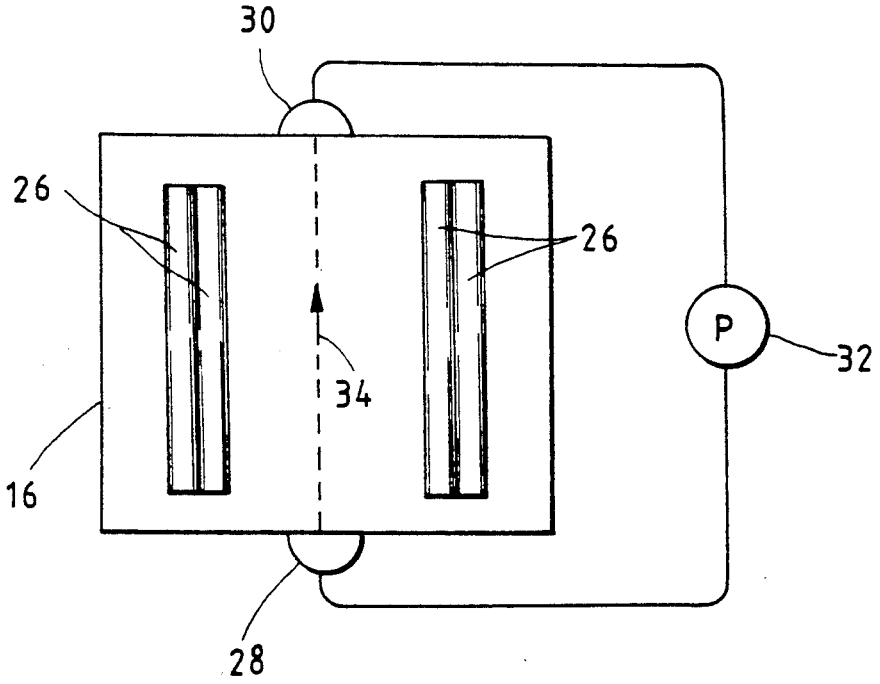
FIG. 3 is a plan view of the fixing tank of FIG. 2.

The fixing tank 16 is shown in FIGS. 2 and 3. A plurality of, seven pairs in the illustrated embodiment, opposed rollers 26 are arranged in the fixing tank 16 to define a generally U-shaped path for the photosensitive material. The fixing tank 16 is provided with a circulation line including an inlet port 28, an outlet 30 and a pump 32. With the pump 32 actuated, the fixing solution is circulated transverse to the surface of photosensitive material through the tank as shown by an arrow 34. The circulating flow of solution is generally transverse to the surface of photosensitive material with respect to its travel direction.

Fixation

The fixer of the invention contains a meso-ionic compound of formula (I):

(I)

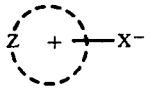

wherein Z is a five or six-membered ring composed of atoms selected from the group consisting of carbon, nitrogen, oxygen, sulfur, and selenium atoms, and $X^-$ is $—O^-$, $—S^-$ or $—NR^-$, wherein R is selected from the group consisting of an alkyl, cycloalkyl, alkenyl, alkynyl, aralkyl, aryl, and heterocyclic group.

More particularly, in formula (I), Z represents a five-membered heterocyclic ring which includes imidazolium, pyrazolium, oxazolium, thiazolium, triazolium, tetrazolium, thiadiazolium, oxadiazolium, thiatriazolium, and oxatriazolium rings. Also included in Z are six-membered heterocyclic rings such as 7H-imidazo[4,5-d]-pyrimidine rings.

The groups represented by R include substituted or unsubstituted alkyl groups (e.g. methyl, ethyl, n-propyl, n-butyl, isopropyl, n-octyl, carboxyethyl, ethoxycarbonylmethyl, and dimethylaminoethyl groups), substituted or unsubstituted cycloalkyl groups (e.g., cyclohexyl and 4-methylcyclohexyl groups), substituted or unsubstituted alkenyl groups (e.g., propenyl group), substituted or unsubstituted alkynyl groups (e.g., propargyl and 1-methylpropargyl groups), substituted or unsubstituted aralkyl groups (e.g., benzyl and 4-methoxybenzyl groups), substituted or unsubstituted aryl groups (e.g., phenyl and 3-methoxyphenyl groups), and substituted or unsubstituted heterocyclic groups (e.g., pyridyl, imidazolyl, morpholino, triazolyl, tetrazolyl, and thienyl groups).

The heterocyclic groups represented by Z may be substituted with nitro groups, halogen atoms (e.g., chlorine and bromine atoms), mercapto groups, cyano groups, substituted or unsubstituted alkyl groups (e.g., methyl, ethyl, propyl, methoxyethyl, methylthioethyl, dimethylaminoethyl, trimethylammonioethyl, carboxymethyl, carboxyethyl, carboxypropyl, sulfoethyl, sulfomethyl, phosphonomethyl, and phosphonoethyl groups), aryl groups (e.g., phenyl and 4-sulfophenyl groups), alkenyl groups (e.g., allyl group), cycloalkyl groups (e.g., cyclohexyl group), alkynyl groups (e.g., propargyl group), aralkyl groups (e.g., benzyl and 4-methylbenzyl groups), alkoxy groups (e.g., methoxy, ethoxy, and methoxyethoxy groups), aryloxy group (e.g., phenoxy group), alkylthio groups (e.g., methylthio and ethylthio groups), arylthio groups (e.g., phenylthio group), sulfonyl groups (e.g., methanesulfonyl and p-toluenesulfonyl groups), carbamoyl groups (e.g., unsubstituted carbamoyl and methylcarbamoyl groups), thiocarbamoyl groups (e.g., dimethylthiocarbamoyl group), sulfamoyl groups (e.g., unsubstituted sulfamoyl, methylsulfamoyl, and phenylsulfamoyl groups), carbonamido groups (e.g., acetamido, benzamido, and methoxypropionamido groups), sulfonamido groups (e.g., methanesulfonamido and benzenesulfonamido groups), acyloxy groups (e.g., acetyloxy and benzoyloxy groups), sulfonyloxy groups (e.g., methanesulfonyloxy group), ureido groups (e.g., unsubstituted ureido, methylureido, ethylureido, and methoxyethylureido groups), thioureido groups (e.g., unsubstituted thioureido, methylthioureido, and methoxyethylthioureido groups), sulfamoylamino groups (e.g., unsubstituted sulfamoylamino and dimethylsulfamoylamino groups), acyl groups (e.g., acetyl and 4-methoxybenzoyl groups), thioacyl groups (e.g., thioacetyl group), heterocyclic groups (e.g., 1-morpholino, 1-piperidino, 2-pyridyl, 4-pyridyl, 2-thienyl, 1-pyrazolyl, 1-imidazolyl, 2-tetrahydrofuryl, and tetrahydrothienyl groups), oxycarbonyl groups (e.g., methoxycarbonyl, phenoxycarbonyl, and methoxyethoxycarbonyl groups), oxycarbonylamino groups (e.g., methoxycarbonylamino group), amino groups (e.g., unsubstituted amino and dimethylamino groups), carboxylic acid or carboxylate, sulfonic acid or sulfonate, hydroxyl group or the like.

The compounds of formula (I) may form salts such as acetates, nitrates, salicylates, hydrochlorates, iodates, and bromates.

In formula (I), $X^-$ is preferably $—S^-$.

Preferred among the compounds of formula (I) are those of the general formula (II):

(II)

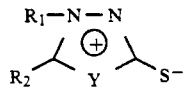

wherein $R_1$ and $R_2$ are independently selected from the group consisting of an alkyl, cycloalkyl, alkenyl, alkynyl, aralkyl, aryl, and heterocyclic group, $R_2$ may also be a hydrogen atom, and Y is $—O^-$, $—S^-$, or $—N(R_3)^-$ wherein $R_3$ is selected from the group consisting of an alkyl, cycloalkyl, alkenyl, alkynyl, aryl, heterocyclic, amino, acylamino, sulfonamido, ureido, and sulfamoylamino group, and $R_1$ and $R_2$, and $R_2$ and $R_3$, taken together, may form a ring.

More particularly, in formula (II), $R_1$ and $R_2$ represent substituted or unsubstituted alkyl groups (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, and phosphonoethyl groups), substituted or unsubstituted cycloalkyl groups (e.g., cyclohexyl, cyclopentyl, and 2-methylcyclohexyl groups), substituted or unsubstituted alkenyl groups (e.g., allyl and 2-methylallyl groups), substituted or unsubstituted alkynyl groups (e.g., propargyl group), substituted or unsubstituted aralkyl groups (e.g., benzyl, phenethyl and 4-methoxybenzyl groups), substituted or unsubstituted aryl groups (e.g., phenyl, naphthyl, 4-methylphenyl, 4-methoxyphenyl, 4-carboxyphenyl, and 4-sulfophenyl groups), and substituted or unsubstituted heterocyclic groups (e.g., 2-pyridyl, 3-pyridyl, 4-pyridyl, 2-thienyl, 1-pyrazolyl, 1-imidazolyl, and 2-tetrahydrofuryl groups). It is to be noted that $R_2$ may also be a hydrogen atom.

$R_3$ represents substituted or unsubstituted alkyl groups (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, and phosphonoethyl groups), substituted or unsubstituted cycloalkyl groups (e.g., cyclohexyl, cyclopentyl, and 2-methylcyclohexyl groups), substituted or unsubstituted alkenyl groups (e.g., allyl and 2-methylallyl groups), substituted or unsubstituted alkynyl groups (e.g., propargyl group), substituted or unsubstituted aralkyl groups (e.g., benzyl, phenethyl and 4-methoxybenzyl groups), substituted or unsubstituted aryl groups (e.g., phenyl, naphthyl, 4-methylphenyl, 4-methoxyphenyl, 4-carboxyphenyl, and 4-sulfophenyl groups), substituted or unsubstituted heterocyclic groups (e.g., 2-pyridyl, 3-pyridyl, 4-pyridyl, 2-thienyl, 1-pyrazolyl, 1-imidazolyl, and 2-tetrahydrofuryl groups), substituted or unsubstituted amino groups (e.g., unsubstituted amino, dimethylamino, and methylamino groups), acylamino groups (e.g., acetylamino, benzoylamino, and methoxypropionylamino groups), sulfonamido groups (e.g., methanesulfonamido, benzenesulfonamido, and 4-toluenesulfonamido groups), ureido groups (e.g., unsubstituted ureido and 3-methylureido groups), and sulfamoylamino groups (e.g., unsubstituted sulfamoylamino and 3-methylsulfamoylamino groups).

Preferably, in formula (II), Y is $-N(R_3)-$, $R_1$ and $R_3$ represent a substituted or unsubstituted alkyl group, substituted or unsubstituted alkenyl group, substituted or unsubstituted alkynyl group, or substituted or unsubstituted heterocyclic group, and $R_2$ represents a hydrogen atom, substituted or unsubstituted alkyl group, substituted or unsubstituted alkenyl group, substituted or unsubstituted alkynyl group, or substituted or unsubstituted heterocyclic group.

Illustrative, non-limiting examples of the meso-ionic compounds within the scope of formula (I) are given below.

1.

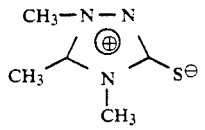

2.

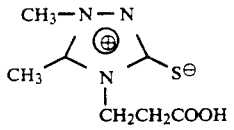

3.

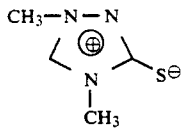

4.

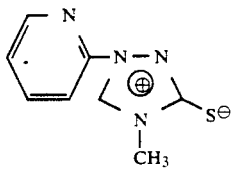

-continued

5.

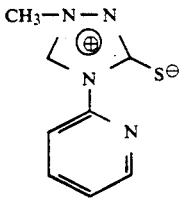

6.

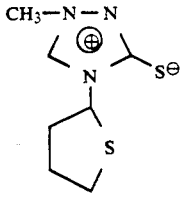

7.

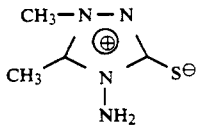

8.

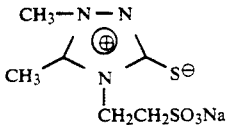

9.

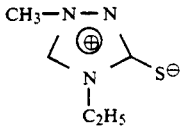

10.

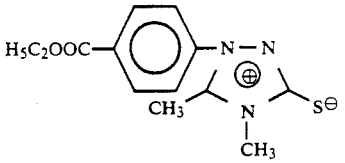

11.

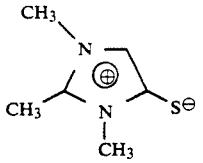

12.

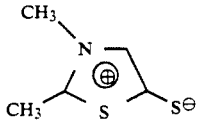

13.

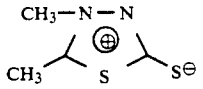

14.

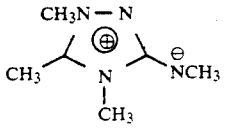

-continued

15.

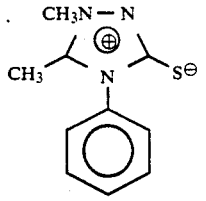

16.

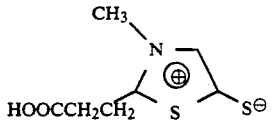

17.

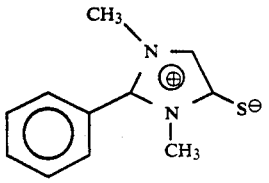

18.

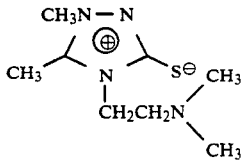

19.

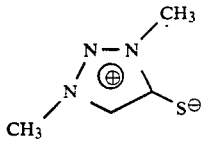

The compounds of formula (I) or (II) used herein can be synthesized by conventional methods. Reference is made to J. Heterocyclic Chem., 2, 105 (1965), J. Org. Chem., 32, 2245 (1967), J. Chem. Soc., 3799 (1969), J. Am. Chem. Soc., 80, 1895 (1958), Chem. Commun., 1222 (1971), Tetrahedron Letters, 2939 (1972), JP A 87322/1985, Berichte der Deutschen Chemischen Gesellschaft, 38, 4049 (1905), J. Chem. Soc. Chem. Commun., 1224 (1971), JP-A 122936/1985, JP-A 117240/1985, Advances in Heterocyclic Chemistry, 19, 1 (1976), Tetrahedron Letters, 5881 (1968), J. Heterocyclic Chem., 5, 277 (1968), J. Chem. Soc., Perkin Trans. I, 627 (1974), Tetrahedron Letters, 1809 (1976), ibid, 1578 (1971), J. Chem. Soc., 899 (1935), ibid, 2865 (1959), and J. Org. Chem., 30, 567 (1965).

The compound of formula (I) may be added to either a fixer (tank solution) or a fixer replenisher. It is present in a concentration of about 0.003 to 0.3 mol/liter of the fixer.

In combination with the compound of formula (I), there is used a conventional fixing agent, for example, sodium thiosulfate and ammonium thiosulfate. Ammonium thiosulfate is most preferred for fixing speed. A thiosulfate fixing agent is used in a concentration of about 0.5 to about 2.0 mol/liter. It is to be noted that when two or more thiosulfates are present, this concentration is a total one.

According to the present invention, the molar concentration (Y) of the meso-ionic compound of formula (I) divided by the molar concentration (X) of the thiosulfate, Y/X, ranges from 0.003 to 0.2, preferably from 0.01 to 0.15.

If desired, the fixer may contain film hardening agents (for example, water-soluble aluminum compounds), preservatives (for example, sulfites and bisulfites), pH buffer agents (for example, acetic acid and boric acid), pH adjusting agents (for example, ammonia and sulfuric acid), chelating agents, surfactants, humectants, and fixing promoters. Included in the surfactants are anionic surfactants such as sulfates and sulfonates, polyethylene surfactants, ampholytic surfactants as disclosed in JP-A 6840/1982. Well-known defoaming agents may also be added. The humectants include alkanol amines and alkylene glycols. The fixing promoters include thiourea derivatives as disclosed in Japanese Patent Publication (JP-B) Nos. 35754/1970, 122535/1983, and 122536/1983, alcohols having a triple bond in a molecule, and thioethers as disclosed in U.S. Pat. No. 4,126,459. The pH buffer agents include organic acids such as acetic acid, malic acid, succinic acid, tartaric acid, and citric acid, and inorganic buffer agents such as boric acid, phosphates, and sulfites, with the inorganic buffer agents being preferred for controlled smell and corrosion of the equipment. The pH buffer agents are used for the purpose of preventing the fixer from increasing its pH as a result of the developer being carried over, preferably in an amount of about 0.1 to 1.0 mol/liter, more preferably about 0.2 to 0.6 mol/liter.

Examples of the film hardening agents added to the fixer include water-soluble aluminum salts and chromium salts. Preferred are water-soluble aluminum salts, for example, aluminum chloride, aluminum sulfate and potassium alum.

The fixing temperature and time are preferably about 20° to about 50° C. and about 5 seconds to about 1 minute, respectively.

The fixer replenisher is replenished to the fixing tank at a rate of up to 600 ml per square meter of photosensitive material to be processed (ml/m$^2$), especially up to 350 ml/m$^2$.

Development

Most often, the processing of photosensitive material starts from development with a developer as previously mentioned. The developer may contain conventional additives including developing agents, alkaline agents, pH buffer agents, preservatives, and chelating agents. The development can be carried out by any well-known conventional procedure with any well-known conventional developer. The developing agent used in the black-and-white developer is not critical although dihydroxybenzenes are preferred. Combinations of a dehydroxybenzene with a 1-phenyl-3-pyrazolidone or p-aminophenol are preferred for better performance.

Examples of the dihydroxybenzene developing agent include hydroquinone, chlorohydroquinone, isopropylhydroquinone, and methylhydroquinone, with the hydroquinones being preferred. Examples of the 1-phenyl-3-pyrazolidone developing agent include 1-phenyl-3-pyrazolidone, 1-phenyl-4,4-dimethyl-3-pyrazolidone, and 1-phenyl-4-methyl-4-hydrozymethyl-3-pyrazolidone. Examples of the p-aminophenol developing agent include N-methyl-p-aminophenol, p-aminophenol, N-(β-hydroxyethyl)-p-aminophenol, and N-(4-hydroxyphenyl)glycine, with the N-methyl-p-aminophenol being preferred.

The dihydroxybenzene developing agent is preferably used in an amount of 0.05 to 0.8 mol/liter. Where a dihydroxybenzene developing agent is used in combination with a 1-phenyl-3-pyrazolidone or p-aminophenyl developing agent, they are preferably used in an amount of 0.05 to 0.5 mol/liter and up to 0.06 mol/liter, respectively.

The preservatives used in the developer according to the present invention include sodium sulfite, potassium sulfite, lithium sulfite, ammonium sulfite, sodium bisulfite, potassium metabisulfite, and sodium formaldehyde bisulfite. The sulfite is generally used in an amount of at least 0.2 mol/liter, preferably at least 0.3 mol/liter. Since a developer containing an excess amount of sulfite is prone to silver sludging, the upper limit is 1.2 mol/-liter.

For adjusting the pH of the developer, an alkaline agent is used, for example, water-soluble inorganic alkali metal salts such as sodium hydroxide, potassium hydroxide, sodium carbonate, and potassium carbonate.

Other additives used in the developer include a development retarder such as sodium bromide and potassium bromide; an organic solvent such as ethylene glycol, diethylene glycol, triethylene glycol, and dimethylformamide; a development promoter, for example, alkanol amines such as diethanol amine and triethanolamine, imidazole and its derivatives; and an antifoggant or black pepper preventing agent, for example, mercapto compounds such as 1-phenyl-5-mercaptotetrazole, indazole compounds such as 5-nitroindazole, and benzotriazole compounds such as 5-methylbenzotriazole. If desired, a color toning agent, a surfactant, a debubbling agent, a water softener, and a film hardener may be added to the developer. There may also be used the compounds described in JP-A 212651/1987 as a development variation preventing agent and the compounds described in JP-A 267759/1986 as a dissolving aid.

Also added to the developer are buffer agents, for example, boric acid as disclosed in JP-A 186259/1987, and saccharides (e.g., saccharose), oximes (e.g., acetoxime), phenols (e.g., 5-sulfosalicylic acid), and tertiary phosphates (e.g., sodium and potassium salts) as disclosed in JP-A 93433/1985, with boric acid being preferred.

For the purposes of saving the transportation cost, packaging cost and occupying space of the developer, the developer is available in concentrate form to be diluted on use. For concentration, it is effective to use potassium salts as the salt components in the developer.

Washing

After development and fixation, the photosensitive material is to be processed with wash water or stabilizer which is replenished at a flow rate of up to 3 liters per square meter of the photosensitive material (inclusive of 0, that is, pool water washing). Water-saving washing is possible and plumbing can sometimes be eliminated from the processor.

Washing with smaller amounts of water is carried out in a washing tank which is preferably equipped with squeeze rollers or crossover rollers as disclosed in JP-A 18350/1988 and 287252/1987. It may be useful to add various additives and to pass the used water through a filter for mitigating the environmental pollution load associated with water-saving washing.

In the case of water-saving washing, wash water or stabilizer should preferably be provided with antifungal means. As water having antifungal means applied thereto is replenished to a washing or stabilizing tank in proportion to the processing quantity, an overflow exits the tank. It is possible to utilize part or all of the overflow as a processing solution having a fixing function in the preceding step as disclosed in JP-A 235133/1985.

Water-soluble surfactants and debubbling agents may be added to washing water for preventing uneven washing due to bubbles frequently generated in the case of water-saving washing and/or preventing chemical components deposited on the squeeze rollers from transferring to the film.

Further, the washing tank may be provided with a dye absorbent as disclosed in JP-A 163456/1988 for preventing contamination by dyes leaching out of the photosensitive material.

Sometimes, water washing is followed by stabilization. A stabilizing bath containing a compound as disclosed in JP-A 201357/1990, 132435/1990, 102553/1989, and 44446/1971, for example, may be used as the final bath for the photosensitive material. If desired, the stabilizing bath may contain ammonium compounds, metal compounds (e.g., Bi and Al compounds), fluorescent brighteners, chelating agents, film pH adjusting agents, film hardeners, antibacterial agents, antifungal agents, alkanolamines and surfactants.

Water used in the washing or stabilizing step may be city water, deionized water, or water sterilized with halogens, UV lamps, or various oxidizing agents (e.g., ozone, hydrogen peroxide, and hydrochloric acid).

In development, the developing time generally ranges up to 25 seconds, preferably from 6 to 15 seconds while the temperature ranges from 25° to 50° C., preferably from 30° to 40° C.

In fixation, the fixing time generally ranges up to 19 seconds at a temperature of about 20° to 50° C., preferably from 6 to 15 seconds at a temperature of about 30° to 40° C.

In water washing or stabilizing, the time generally ranges up to 25 seconds at a temperature of about 0° to 50° C.

Having finished development, fixation and washing (or stabilization), the photosensitive material is removed of the wash water, that is, squeezed of water through squeeze rollers and then dried. Drying is generally at about 40° to 100° C. The drying time may vary with the ambient condition.

Photosensitive Material

The photosensitive material used herein includes a support and a silver halide emulsion layer coated thereon.

The silver halide emulsion used in the photosensitive material may contain any desired silver halide as used in conventional silver halide emulsions, for example, silver bromide, silver iodobromide, silver chloride, silver chlorobromide, and silver chloroiodobromide. Preferred are negative silver halide emulsions containing silver chlorobromide with at least 60 mol % of silver chloride and positive silver halide emulsions containing silver chlorobromide with at least 60 mol % of silver bromide, silver bromide or silver iodobromide. Silver halide grains may be prepared by any of acidic, neutral and ammoniacal methods and include grains having a uniform silver halide distribution throughout and core/-shell grains in which a surface layer has a different silver halide composition from the interior. They may be either grains in which latent images are mainly formed at the surface or grains in which latent images are mainly formed in the interior.

The silver halide grains may have any desired shape. One preferred shape is cubic having the {100} plane as the crystal surface. Also acceptable are grains of octahedral, tetradecahedral, and dodecahedral shapes as prepared by the method disclosed in U.S. Pat. No. 4,183,756, U.S. Pat. No. 4,225,666, JP-A 26589/1980, JP-B 42737/1980, and J. Photgr. Sci., 21-39 (1973). Grains having a twin surface may also be used.

The silver halide grains used herein may be grains having an identical shape or a mixture of grains having different shapes.

Preferred are monodispersed emulsions, which should preferably contain silver halide grains in such a distribution that the weight of those silver halide grains having a grain size falling within ±10% with respect to a mean grain size $\gamma$ is at least 60% by weight of the total weight of silver halide grains.

Metal ions may be introduced into the surface and/or interior of silver halide grains by adding a suitable metal salt (for example, cadmium salts, zinc salts, lead salts, thallium salts, iridium salts or complex salts, rhodium salts or complex salts, and iron salts or complex salts) during formation and/or growth of silver halide grains.

The photographic emulsion used herein may be sensitized by any desired sensitizing method, for example, sulfur sensitization, gold and sulfur sensitization, reductive sensitization using reducing materials, and noble metal sensitization using noble metal compounds, and combinations thereof. At the end of chemical sensitization, various stabilizers, for example, 4-hydroxy-6-methyl-1,3,3a,7-tetraazaindene, 5-mercapto-1-phenyltetrazole, and 2-mercaptobenzothiazole may be added to the emulsion. If necessary, silver halide solvents such as thioethers and crystal habit controlling agents such as mercapto-containing compounds and sensitizing dyes may be used. Especially in the case of graphic printing photosensitive material, high contrast agents such as tetrazolium compounds, hydrazine compounds and polyalkylene oxide compounds may be used with better results.

Photosensitive emulsions may be used alone or in admixture of two or more.

The photographic emulsion used in the photographic silver halide photosensitive material according to the invention may be spectrally sensitized with sensitizing dyes for blue light, green light, red light or infrared light having a relatively long wavelength. The sensitizing dyes used herein include cyanine dyes, merocyanine dyes, complex cyanine dyes, complex merocyanine dyes, holopolar cyanine dyes, hemicyanine dyes, styryl dyes, and hemioxonol dyes. The sensitizing dyes may be used alone or in admixture of two or more. Such a mixture of sensitizing dyes is often used for supersensitization purposes.

Included in the photographic silver halide photosensitive material according to the invention is a hydrophilic colloidal layer which may contain water-soluble dyes as filter dyes for the purpose of preventing irradiation and halation. These dyes include oxonol dyes, hemioxonol dyes, styryl dyes, merocyanine dyes, cyanine dyes, and azo dyes, with the oxonol dyes, hemioxonol dyes, and merocyanine dyes being preferred. Specific examples are illustrated in German Patent No. 616,007, British Patent Nos. 584,609 and 1,117,429, JP-B 7777/1951, 22069/1964, and 8129/1979, JP-A 85130/1973, 99620/1974, 114420/1974, and 29537/1974, PB Report No. 74175, and Photo. Abstr., 128 ('21). The use of these dyes is recommended in the case of room-light contact lithographic films. In the photographic silver halide photosensitive material, the hydrophilic colloidal layer contains a dye or UV absorber, which may be mordanted with a cationic polymer.

Various suitable compounds may be added to the photographic emulsions for the purpose of preventing sensitivity lowering or fogging during preparation, storage and processing of the photographic silver halide photosensitive material according to the invention.

Also useful is a technique of adding polymer latex to a silver halide emulsion layer or backing layer for improved dimensional stability (see JP-B 4272/1964, 17702/1964, and 13482/1968).

Most often gelatin is used as the binder for photosensitive material. In combination with gelatin, there may be used hydrophilic colloids such as, for example, gelatin derivatives, cellulose derivatives, graft polymers of gelatin with other polymers, other proteins, saccharide derivatives, and synthetic hydrophilic polymers (homopolymers and copolymers).

The photographic photosensitive material used herein may further contain other additives selected for their own purpose. These additives are described in Research Disclosure, No. 176, Item 17643 (December 1978) and No. 187, Item 18716 (November 1979). They are listed below together with the pages to be referred to in the literature. Letters R and L mean right and left columns of the page.

| | Additive | RD17643 | RD18716 |
|---|---|---|---|
| 1. | Chemical sensitizer | 23 | 648R |
| 2. | Sensitivity increasing agent | 23 | 648R |
| 3. | Spectral sensitizer/ Supersensitizer | 23-24 | 648R-649R |
| 4. | Brightener | 24 | |
| 5. | Antifoggant/stabilizer | 24-25 | 649R |
| 6. | Light absorber/filter dye/ UV absorber | 25-26 | 649R-650L |
| 7. | Anti-staining agent | 25R | 650L-R |
| 8. | Dye image stabilizing agent | 25 | |
| 9. | Hardener | 26 | 651L |
| 10. | Binder | 26 | 651L |
| 11. | Plasticizer/lubricant | 27 | 650R |
| 12. | Coating aid/surfactant | 26-27 | 650R |
| 13. | Antistatic agent | 27 | 650R |

The support used in the photosensitive material according to the invention may be selected from flexible reflective supports in the form of paper and synthetic paper sheets laminated with $\alpha$-olefin polymer (e.g., polyethylene, polypropylene, and ethylene-butene copolymers); films of semi-synthetic or synthetic polymers such as cellulose acetate, cellulose nitrate, polystyrene, polyvinyl chloride, polyethylene terephthalate, polycarbonate, and polyamides; flexible supports in the form of the above-mentioned films having a reflective layer thereon; and metal supports. Polyethylene terephthalate film is most preferred.

An undercoat is often applied to the support, for example, undercoat layers formed from organic solvent systems containing polyhydroxybenzenes as disclosed in JP-A 3972/1974 and undercoat layers of aqueous latex systems as disclosed in JP-A 11118/1974 and 104913/1977. The undercoat layer is often chemically or physically treated on the surface. Useful are surface activating treatments such as chemical treatment, mechanical treatment, and corona discharge treatment.

The present invention is applicable to a variety of photosensitive materials including graphic printing, X-ray, general negative, general reversal, general positive, and general positive photosensitive materials.

The processing solutions used herein are preferably stored in containers having low oxygen permeability as disclosed in JP-A 73147/1986.

For operation in a reduced replenishment mode, it is desired to reduce the area of contact of the processing solution in the tank with air for restricting evaporation and air oxidation of the solution.

Automatic processors of the roller conveyor type are described in U.S. Pat. No. 3,025,779 and 3,545,971. Such roller conveyor processors involve four steps of development, fixation, washing, and drying. The method of the present invention most preferably follows these four steps although it is not excluded to add any other step (for example, stopping).

EXAMPLE

Examples of the present invention are given below by way of illustration and not by way of limitation. In the examples, MW is an average molecular weight, PET is polyethylene terephthalate, and EDTA is ethylenediaminetetraacetic acid.

EXAMPLE 1

Preparation of Emulsion

An aqueous silver nitrate solution and an aqueous solution containing sodium chloride, sodium bromide, $3\times10^{-8}$ mol of $K_3IrCl_6$ and $3\times10^{-7}$ mol of $(NH_4)_3RhCl_6$ per mol of silver were concurrently added to an aqueous gelatin solution at 40° C. over 30 minutes while keeping a potential of 200 mV. There was prepared a monodispersed silver chlorobromide emulsion having a mean grain size of 0.15 μm. The emulsion was subjected to conversion by adding an aqueous solution containing 0.1 mol % of potassium iodide per mole of silver, desalted by flocculation, and dispersed in gelatin, obtaining an emulsion ($AgCl_{69.9}Br_{30}I_{0.1}$, dispersion coefficient 10%).

To the emulsion were added sodium thiosulfate and N,N-dimethylselenourea. The emulsion was kept at 60° C. for chemical ripening before a solution containing 1% of 4-hydroxy-6-methyl-1,3,3a,7-tetraazaindene as a stabilizer was added in an amount of 30 ml per mol of silver.

To 1 kg of the emulsion was added 60 ml of a solution containing 0.05% of a compound of the following structural formula (21) as an infrared sensitizing dye for sensitization in the infrared region.

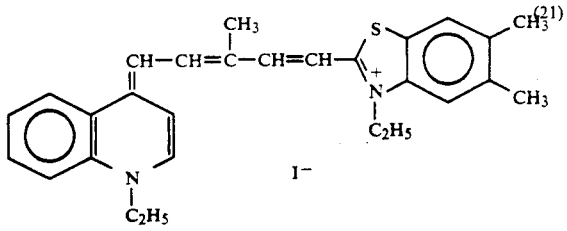

(21)

To the emulsion were added 50 ml of a methanol solution containing 0.5% of disodium 4,4'-bis[4,6-di(naphthoxy)pyrimidin-2-ylamino]-stylbene-2,2'-disulfonate, 90 ml of a methanol solution containing 0.5% of 2,5-dimethyl-3-allylbenzothiazole iodide, and 15 ml of an aqueous solution containing 1% of potassium bromide for supersensitization and stabilization. Additionally, 100 mg/m² of hydroquinone, 25% based on the gelatin binder of polyethyl acrylate as a polymer latex, and 2-bis(vinylsulfonylacetamido)ethane as a hardener were added to the emulsion.

A PET support was coated with the emulsion to a coating weight corresponding to 3.5 g/m² of silver and a gelatin coverage of 1.3 g/m².

The protective layer was formed on the emulsion layer from a composition composed of 0.6 g/m² of gelatin, 60 mg/m² of polymethyl methacrylate having a particle size of 3–4 μm as a matte agent, 40 mg/m² of colloidal silica having a particle size of 10–20 mμ, 100 mg/m² of silicone fluid, 20 mg/m² of a dye of the following structural formula (23), 10 mg/m² of a dye of the following structural formula (24), sodium dodecylbenzenesulfonate as a coating aid, and a fluorinated surfactant of the following structural formula (22). At the same time, the support on the back surface was coated with a back layer using a composition composed of 0.7 g/m² of gelatin, 225 mg/m² of polyethyl acrylate latex, 70 mg/m² of a dye of the following structural formula (24), 40 mg/m² of polymethyl methacrylate having a mean particle size of 5 μm as a matte agent, sodium dodecylbenzenesulfonate as a coating aid, and 2 mg/m² of a fluorinated surfactant of structural formula (22). A photosensitive material was completed in this way.

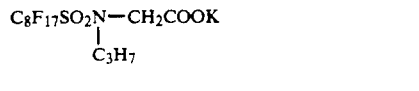

(22)

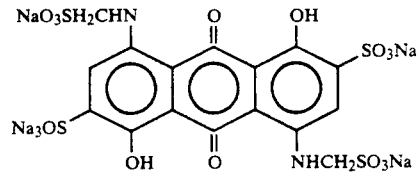

(23)

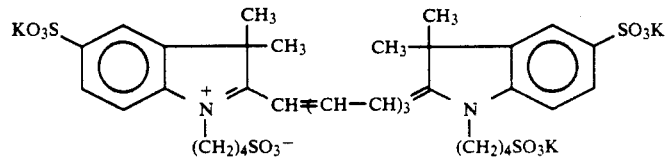

(24)

Using an automatic processor, the photosensitive material without exposure was processed with a developer and then with a fixer, both formulated as shown below. The processor had a developing tank, a fixing tank, and a washing tank, among which the fixing and washing tanks were of the same type having 7 pairs of opposed rollers. The photosensitive material was of 20×24 inches in size.

| Developer (tank solution) | gram/liter |
|---|---|
| Potassium hydroxide | 24 |
| Potassium sulfite | 70 |
| Diethylenetriaminepentaacetate | 2.4 |
| Boric acid | 10 |
| Hydroquinone | 35 |
| Diethylene glycol | 11.2 |
| 4-hydroxymethyl-4-methyl-1-phenyl-3-pyrazolidone | 2.5 |
| 5-methylbenzotriazole | 0.06 |
| pH | 10.65 |
| Fixer | |
| Ammonium thiosulfate | see Table 1 |
| Meso-ionic compound | see Table 1 |
| Sodium acetate | 15 |
| Sodium sulfite | 9.0 |
| Sodium bisulfite | 15 |
| Disodium EDTA dihydrate | 0.025 |
| pH adjusted with sodium hydroxide to | 5.5 |
| Processor's processing conditions | |
| Fixing time | 10 sec. |
| Line speed | 28 mm/sec. |
| Fixer circulating flow rate | 48 m/min. |
| Fixer circulation amount | 54% |
| Rollers | 7 pairs |
| Developer temperature | 38° C. |
| Fixer temperature | 37° C. |

The processed photosensitive material sample (20×24 inches) was examined for fixation rate and residual silver. Fixation results are rated "O", "X", and "XX" according to the following criterion.

O: thorough fixation

X: partially unthorough fixation

XX: overall unthorough fixation

The residual silver is the amount of residual silver measured at the center of the sample. The residual silver amount should be smaller, specifically below 10 mg/m$^2$.

The results are shown in Table 1.

TABLE 1

| Run No. | Ammonium thiosulfate mol/l (x) | Meso-ionic compound Type | Meso-ionic compound mol/l (Y) | (Y)/(X) | Rating of fixation | Residual Ag, mg/m$^2$ |
|---|---|---|---|---|---|---|
| 1* | 0.4 | — | — | 0 | x x | 230 |
| 2* | 0.4 | 1 | 0.02 | 0.05 | x x | 190 |
| 3* | 0.4 | 1 | 0.1 | 0.25 | x x | 150 |
| 4* | 0.4 | 1 | 0.4 | 1.0 | x x | 310 |
| 5* | 0.8 | — | — | 0 | x x | 85 |
| 6 | 0.8 | 1 | 0.02 | 0.025 | ○ | 4 |
| 7 | 0.8 | 1 | 0.1 | 0.125 | ○ | 1 |
| 8* | 0.8 | 1 | 0.4 | 0.5 | x | 43 |
| 9* | 1.5 | — | — | 0 | x | 35 |
| 10 | 1.5 | 1 | 0.02 | 0.013 | ○ | 2 |
| 11 | 1.5 | 1 | 0.1 | 0.067 | ○ | 0 |
| 12* | 1.5 | 1 | 0.4 | 0.27 | x | 27 |
| 13* | 2.2 | — | — | 0 | x | 93 |
| 14* | 2.2 | 1 | 0.02 | 0.009 | x | 26 |
| 15* | 2.2 | 1 | 0.1 | 0.045 | x | 20 |
| 16* | 2.2 | 1 | 0.4 | 0.18 | x x | 107 |
| 17 | 0.8 | 2 | 0.1 | 0.125 | ○ | 3 |
| 18* | 0.8 | 2 | 0.4 | 0.5 | x | 38 |
| 19 | 0.8 | 4 | 0.1 | 0.125 | ○ | 2 |
| 20* | 0.8 | 4 | 0.4 | 0.5 | x | 52 |
| 21 | 0.8 | 9 | 0.1 | 0.125 | ○ | 4 |
| 22* | 0.8 | 9 | 0.4 | 0.5 | x | 29 |
| 23 | 0.8 | 11 | 0.1 | 0.125 | ○ | 2 |
| 24* | 0.8 | 11 | 0.4 | 0.5 | x | 65 |
| 25 | 0.8 | 14 | 0.1 | 0.125 | ○ | 2 |
| 26* | 0.8 | 14 | 0.4 | 0.5 | x | 42 |
| 27 | 0.8 | 15 | 0.1 | 0.125 | ○ | 3 |
| 28* | 0.8 | 15 | 0.4 | 0.5 | x | 37 |

*comparison

As seen from Table 1, better fixation ratings are achieved with fixers using a meso-ionic compound in combination with ammonium thiosulfate according to the invention. Lower concentrations of ammonium thiosulfate lead to slow fixation. The fixation rating becomes better as the concentration of ammonium thiosulfate is increased, but becomes worse again when the concentration is further increased.

It is seen that satisfactory results are obtained only when the meso-ionic compound of the invention is added in a specific amount like the concentration of ammonium thiosulfate.

EXAMPLE 2

Using an automatic processor, the photosensitive material prepared in Example 1 without exposure was processed with a developer and then with a fixer, both formulated as shown below. The processor was of the design that the line speed, fixer circulating flow rate and circulating amount were variable, and had a developing tank, a fixing tank, and a washing tank, among which the fixing and washing tanks were of the same type. The photosensitive material was of 20×24 inches in size.

| Developer (tank solution) | | | gram/liter |
|---|---|---|---|
| Potassium hydroxide | | | 24 |
| Potassium sulfite | | | 70 |
| Diethylenetriaminepentaacetate | | | 2.4 |
| Boric acid | | | 10 |
| Hydroquinone | | | 35 |
| Diethylene glycol | | | 11.2 |
| 4-hydroxymethyl-4-methyl-1-phenyl-3-pyrazolidone | | | 2.5 |
| 5-methylbenzotriazole | | | 0.06 |
| pH | | | 10.65 |
| Fixers | A | B | |
| Ammonium thiosulfate | 150 g/l | 150 g/l | |
| Meso-ionic compound No. 1 | — | 0.10 mol/l | |
| Sodium bisulfite | 30 g/l | 30 g/l | |
| Disodium EDTA dihydrate | 0.025 g/l | 0.025 g/l | |
| pH adjusted with sodium hydroxide to 6.0 | | | |
| Processor's processing conditions | (1) | (2) | (3) |
| Fixing time, sec | 10 | 10 | 10 |
| Line speed, mm/sec. | 27 | 27 | 27 |
| Fixer circulating flow rate, m/min. | 48 | 48 | 130 |
| Fixer circulation amount, % | 54 | 54 | 160 |
| Roller pairs | 2 | 7 | 7 |

Development was carried out at a temperature of 38° C. for 15 seconds, fixation was at a temperature of 37° C. for 10 seconds, and the total dry-to-dry processing time was 50 seconds.

It is understood that for fixer B containing 1.01 mol/liter of ammonium thiosulfate, the concentration of meso-ionic compound No. 1 divided by the concentration of ammonium thiosulfate was 0.10.

The processed photosensitive material sample (20×24 inches) was examined for fixation rate and residual silver as in Example 1.

The results are shown in Table 2.

TABLE 2

| Run No. | Fixer | Processor condition | Rating of fixation | Residual Ag, mg/m$^2$ |
|---|---|---|---|---|
| 201* | A | 1 | X | 65 |
| 202* | A | 2 | X | 47 |
| 203* | A | 3 | X | 35 |
| 204 | B | 1 | ○ | 6 |
| 205 | B | 2 | ○ | 2 |
| 206 | B | 3 | ○ | 0 |

*comparative examples

It is evident from Table 2 that fixer B containing a meso-ionic compound in combination with ammonium thiosulfate show a good rating of fixation and a minimal amount of residual silver, better results are obtained with a larger number of rollers in the fixing tank, and best results are obtained with run No. 6 where the flow velocity and amount of the fixer circulated through the fixing tank are within the preferred ranges.

EXAMPLE 3

Preparation of Emulsion

A container was charged with 1 liter of water at 60° C., to which 30 grams of gelatin and 6 grams of potassium bromide were added. With stirring, an aqueous solution containing 5 grams of silver nitrate and another aqueous solution containing 0.15 grams of potassium iodide were added to the container over one minute by the double jet technique. Further, an aqueous solution containing 145 grams of silver nitrate and another aqueous solution containing 2.1 grams of potassium iodide were added to the container by the double jet technique. The flow rate was accelerated such that the flow rate at the end of addition was 5 times the flow rate at the start of addition. At the end of addition, the emulsion was cooled to 35° C. for removing the soluble salts by sedimentation. The emulsion was warmed to 40° C., combined with 75 grams of gelatin, and adjusted to pH 6.7. The resulting emulsion contained plate grains having a projected area diameter of 0.98 μm and an average thickness of 0.138 μm. The emulsion was chemically sensitized by combined gold and sulfur sensitization.

Preparation of Photographic Material

For a surface protective layer, there was prepared an aqueous gelatin solution containing gelatin, polyacrylamide having an average molecular weight of 8,000, sodium polystyrene sulfonate, polymethyl methacrylate fine particles having a mean particle size of 3.0 μm, polyethylene oxide, and a hardener.

To the above-prepared emulsion were added 500 mg/mol or Ag of anhydrous sodium 5,5'-dichloro-9-ethyl-3,3'-di(3-sulfopropyl)oxacarbocyanine hydroxide as a sensitizing dye and 200 mg/mol Ag of potassium iodide. Further added were 4-hydroxy-6-methyl-1,3,3a,7-tetraazaindene, 2,6-bis(hydroxyamino)-4-diethylamino-1,3,5-triazine, and nitron as stabilizers, trimethylol propane as an anti-dry-fogging agent, a coating aid, and a hardener. A PET support on either surface was concurrently coated with the emulsion and the gelatin solution to form an emulsion layer and a surface protective layer thereon, respectively. The emulsion layer had a coating weight corresponding to 3.5 g/m$^2$ of silver, a thickness of 4.0 μm, and a swelling factor of 180%.

Using an automatic processor, the photosensitive material was developed with a developer at 35° C., fixed with a fixer at 35° C., washed with water at normal temperature, and then dried. The developer used was LD-745 (Fuji Photo-Film Co., Ltd.). The fixer used was of the following formulation.

| Fixer | C | D |
|---|---|---|
| Ammonium thiosulfate | 190.0 g | 190.0 g |
| Meso-ionic compound No. 8 | — | 0.2 mol |
| Sodium sulfite | 22.0 g | 22.0 g |
| Disodium EDTA | 0.1 g | 0.1 g |
| Tartaric acid | 1.0 g | 1.0 g |
| Aqueous ammonia (27%) | 5 g | 5 g |
| Acetic acid (90%) | 30.0 g | 30.0 g |
| Aluminum sulfate (27%) | 20 g | 20 g |
| Water totaling to | 1 liter | 1 liter |
| pH adjusted with NaOH | 4.8 | 4.8 |

| Processor's processing conditions | (31) | (32) | (33) |
|---|---|---|---|
| Fixing time, sec | 16 | 16 | 16 |
| Line speed, mm/sec. | 20 | 20 | 20 |
| Fixer circulating flow rate, m/min. | 40 | 40 | 110 |
| Fixer circulation amount, % | 42 | 42 | 125 |
| Roller pairs | 2 | 6 | 6 |

It is understood that for fixer D containing 1.28 mol/liter of ammonium thiosulfate, the concentration of meso-ionic compound No. 8 divided by the concentration of ammonium thiosulfate was 0.16.

The processed photosensitive material sample was examined for fixation rate and residual silver as in Example 1.

The results are shown in Table 3.

TABLE 3

| Run No. | Fixer | Processor condition | Rating of fixation | Residual Ag, mg/m$^2$ |
|---|---|---|---|---|
| 301* | C | 31 | XX | 85 |
| 302* | C | 32 | X | 70 |
| 303* | C | 33 | X | 64 |
| 304 | D | 31 | ○ | 8 |
| 305 | D | 32 | ○ | 3 |
| 306 | D | 33 | ○ | 1 |

*comparative examples

It is evident from Table 2 that fixer D containing a meso-ionic compound in combination with ammonium thiosulfate show a good rating of fixation and a minimal amount of residual silver in rapid processing.

EXAMPLE 4

Preparation of Emulsion

To 1 liter of water were added 5 grams of potassium bromide, 0.05 grams of potassium iodide, 30 grams of gelatin, and 2.5 ml of an aqueous solution of 5% thioether $HO(CH_2)_2S(CH_2)_2S(CH_2)_2OH$. With stirring the solution at 73° C., an aqueous solution containing 8.33 grams of silver nitrate and another aqueous solution containing 5.94 grams of potassium bromide and 0.726 grams of potassium iodide were added over 45 seconds by the double jet technique. Further, 2.5 grams of potassium bromide was added to the solution and an aqueous solution containing 8.33 grams of silver nitrate was added over 26 minutes such that the flow rate at the end of addition was twice the flow rate at the start of addition. Thereafter, 20 ml of 25% aqueous ammonia and 10 ml of 50% ammonium nitrate solution were added to the solution which was physically ripened for 20 minutes. After 240 ml of 1N sulfuric acid was added for neutralization, an aqueous solution containing 153.34 grams of silver nitrate and an aqueous potassium bromide solution were added over 40 minutes by the controlled double jet technique while keeping the potential at pAg 8.2. The flow rate was accelerated such that the flow rate at the end of addition was 9 times the flow rate at the start of addition. At the end of addition, 15 ml of 2N potassium thiocyanate solution was added and 25 ml of 1% potassium iodide aqueous solution was added over 30 seconds. The emulsion was cooled to 35° C. for removing the soluble salts by sedimentation. The emulsion was warmed to 40° C., combined with 30 grams of gelatin and 2 grams of phenol, and adjusted to pH 6.40 and pAg 8.10 with caustic soda and potassium bromide.

The emulsion was heated to 56° C., and 600 mg of a sensitizing dye of structural formula (25) and 150 mg of a stabilizer of structural formula (26), shown below, were added thereto. After the lapse of 10 minutes, 2.4 mg of sodium thiosulfate pentahydrate, 140 mg of potassium thiocyanate, and 2.1 mg of chloroauric acid were added to the emulsion which was aged for 80 minutes. The sensitized emulsion was rapidly cooled for solidification.

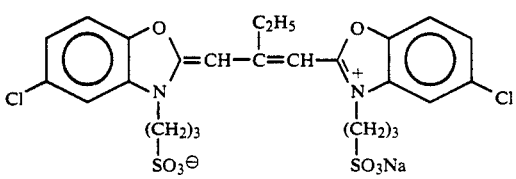

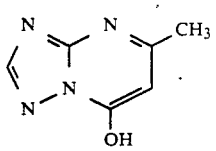

The resulting emulsion contained grains in such a distribution that 98% of the total of the projected areas of all the grains consisted of grains having an aspect ratio of 3 or higher. Those grains having an aspect ratio of 2 or higher had an average projected area diameter of 1.4 μm with a standard deviation of 15%, an average thickness of 0.187 μm, and an aspect ratio of 7.5.

Preparation of Photographic Material

An emulsion coating composition was prepared from the emulsion by adding the following chemical agents per mol of silver halide in the emulsion.

| | | |
|---|---|---|
| 1) | Gelatin<br>Gelatin was added in an amount to give an Ag/binder ratio of 1.0 wherein the binder was gelatin plus polymer. | |
| 2) | Water-soluble polyester<br>WD-SIZE from Eastman Chemical Co. | 15.0 g |
| 3) | Polymer latex<br>Poly(ethyl acrylate/methacrylic acid) = 97/3 | 25.0 g |
| 4) | Hardener<br>1,2-bis(sulfonylacetamido)ethane<br>It was added in an amount to give a silver coverage/swollen thickness ratio as reported in Table 4. | |
| 5) | 2,6-bis(hydroxyamino)-4-diethylamino-1,3,5-triazine | 80 mg |
| 6) | Sodium polyacrylate (MW 4,000) | 4.0 g |
| 7) | Potassium polystyrenesulfonate (MW 600,000) | 1.0 g |

The emulsion coating composition was applied to a transparent PET support of 175 μm thick to a coating weight corresponding to 4.0 g/m² of silver at the same time as a surface protective layer coating composition.

The surface protective layer coating composition was prepared as follows. Symbol n is an abbreviation for degree of polymerization and d for mean particle size.

| Surface protective layer component | Coating weight |
|---|---|
| Gelatin | see Table 4 |
| Polyacrylamide (MW 45,000) | 0.1 g/m² |
| Sodium polyacrylate (MW 400,000) | 0.02 |
| Sodium salt of p-t-octylphenoxy-diglyceryl butyl sulfonate | 0.02 |
| Poly(n = 10)oxyethylene cetyl ether | 0.035 |
| Poly(n = 10)oxyethylene-poly(n = 3)-oxyglyceryl p-octylphenoxy ether | 0.01 |
| $C_8F_{17}SO_3K$ | 0.003 |
| $C_8F_{17}SO_2N(C_3H_7)—(CH_2)_4—(CH_2)_4—SO_3Na$ | 0.001 |
| $C_8F_{17}SO_2N(C_3H_7)—(CH_2CH_2O)_{10}—(CH_2CHCH_2O)_4—H$ | 0.003 |
| Polymethyl methacrylate (d = 3.5 μm) | 0.025 |
| Poly(methyl methacrylate/methacrylate) (molar ratio 7:3, d = 2.5 μm) | 0.020 |

Evaluation of Photographic Performance

Photographic material samples as prepared above (Nos. 401 to 418) were exposed for 1/20 seconds to green light having a peak at 550 nm. Using an automatic processor Model FPM 9000 (Fuji Photo-Film Co., Ltd.), the samples were subjected to treatment at 35° C. (dry-to-dry processing time 45 seconds) with a developer RD7 (Fuji Photo-Film Co., Ltd.) and a fixer of the following composition.

| Fixer | |
|---|---|
| Meso-ionic compound No. 3 | see Table 4 |
| Ammonium thiosulfate | 200 g |
| Sodium sulfite | 17 g |
| Boric acid | 7 g |
| Sodium acetate trihydrate | 24 g |
| Sodium citrate dihydrate | 2 g |
| Aluminum sulfate | see Al in Table 4 |
| Acetic acid | see pH in Table 4 |

These components were diluted with water to a total volume of 1 liter to provide the Al content and pH reported in Table 4. This fixer contained 1.35 mol/liter of ammonium thiosulfate.

The samples were evaluated for the following factors.

Sensitivity

Sensitivity is the inverse of an exposure providing a density of Fog +1.0 and expressed based on a sensitivity of 100 for sample No. 401.

Fixation Rating

Samples of A4 size were processed without exposure and the processed samples were visually observed for fog. Evaluation was made in accordance with the following ratings.

A: fully transparent over the entire area

B: unthorough fixation only partially along the perimeter

C: unthorough fixation partially along the perimeter and at the center

D: unthorough fixation over the entire area

Ratings A and B are acceptable for practical purpose.

Dryness

A number of A4 sized samples were continuously processed through the processor. After 20 samples had been processed, the 21st sample exiting from the processor drying section was evaluated for dryness by finger touch. Evaluation was made in accordance with the following ratings.

A: fully dry and warm film
B: fully dry, but cool film
C: somewhat moist
D: wet

Ratings A and B are acceptable for practical purpose. It is to be noted that the processor drying section was at 50° C. and the room in which the processor was placed was at 25° C. and RH 60%.

Smell

The fixer was warmed at 37° C. and organoleptically examined for foul smell like acetic acid and sulfur dioxide odors. Evaluation was made in accordance with the following ratings.

A: little smell
B: some smell, but not stinking
C: considerable smell
D: nasty smell Ratings A, B, and C are acceptable for practical purpose.

The results are shown in Table 4.

acceptable compromise between dryness and fixation rating is obtained when the silver coverage/swollen thickness ratio is from 0.6 to 1.5.

A smaller amount of Al used as the hardener in the fixer is desirable in view of fixation rating. A higher pH value of the fixer is desirable since the sulfur dioxide gas and acetic acid odors are eliminated.

EXAMPLE 5

An aqueous silver nitrate solution and an aqueous solution of potassium bromide and potassium iodide were mixed in the presence of ammonia by the double jet technique while keeping pAg 7.9. There was obtained a monodispersed cubic silver iodobromide emulsion having a mean particle size of 0.2 μm (silver iodide 2.0 mol %, silver bromide 98.0 mol %).

The silver iodobromide emulsion was chemically ripened, and then $3\times10^{-5}$ mol/mol of silver of sodium thiosulfate was added thereto for sulfur sensitization. To the emulsion was added a sensitizing dye, sodium 5,5'-dichloro-3,3'-di(3-sulfopropyl)-9-ethyl-oxacarbocyanine in an amount of $6\times10^{-4}$ mol/mol of silver for spectral sensitization.

To the emulsion were further added 4-hydroxy-6-methyl-1,3,3a,7-tetraazaindene as a stabilizer, $C_{17}H_{33}CON(CH_3)CH_2CH_2SO_3Na$ as a coating aid, $CH_2{=}CHSO_2CH_2CONH(CH_2)_nNHCOCH_2SO_2CH{=}CH_2$ (n=2 or 3) as a vinylsulfone curing agent, sodium polystyrenesulfonate as a thickener, a polyethyl acrylate dispersion as a latex polymer in an amount corresponding to a coating weight of 0.30 g/m², and a compound of formula (27) in an amount corresponding to a coating weight of 0.40 g/m². To the emulsion were further added 1 gram of hydroquinone and 0.1 gram of 1-phenylmercaptotetrazole as antifoggants, and $6.0\times10^{-4}$ mol of a compound of formula (28) and 0.5 grams of a compound of formula (29) as hydrazine compounds, all per mol of silver.

TABLE 4

| Run No. | Meso-ionic compound No. 3 mol/l | Fixer Al mol/l | Fixer pH | silver coverage/ swollen thickness | Protective layer gelatin coverage g/m² | sensitivity | Fixation rating | Dryness | smell |
|---|---|---|---|---|---|---|---|---|---|
| 1* | — | — | 5.6 | 1.0 | 1.2 | 100 | D | B | A |
| 2* | — | — | 5.6 | 1.0 | 0.7 | 102 | C | B | A |
| 3* | — | 0.003 | 5.6 | 1.0 | 1.2 | 100 | D | A | A |
| 4* | — | 0.003 | 5.6 | 1.0 | 0.7 | 102 | D | A | A |
| 5 | 0.1 | — | 5.6 | 0.5 | 1.2 | 105 | A | B | A |
| 6 | 0.1 | — | 5.6 | 0.5 | 0.7 | 102 | A | B | A |
| 7 | 0.1 | — | 5.6 | 1.0 | 1.2 | 100 | B | B | A |
| 8 | 0.1 | — | 5.6 | 1.0 | 0.7 | 102 | A | B | A |
| 9 | 0.1 | — | 5.6 | 1.6 | 1.2 | 98 | B | A | A |
| 10 | 0.1 | — | 5.6 | 1.6 | 0.7 | 100 | A | A | A |
| 11 | 0.1 | 0.003 | 5.6 | 0.5 | 1.2 | 105 | A | B | A |
| 12 | 0.1 | 0.003 | 5.6 | 0.5 | 0.7 | 102 | A | B | A |
| 13 | 0.1 | 0.003 | 5.6 | 1.0 | 1.2 | 100 | B | A | A |
| 14 | 0.1 | 0.003 | 5.6 | 1.0 | 0.7 | 102 | B | A | A |
| 15 | 0.1 | 0.003 | 5.6 | 1.6 | 1.2 | 98 | B | A | A |
| 16 | 0.1 | 0.003 | 5.6 | 1.6 | 0.7 | 100 | B | A | A |
| 17 | 0.1 | — | 5.0 | 1.0 | 1.2 | 100 | B | B | B |
| 18 | 0.1 | — | 4.3 | 1.0 | 0.7 | 100 | A | B | C |

*comparison

It is evident from Table 4 that good fixation ratings are achieved with fixers containing meso-ionic compound No. 3. Better fixation ratings are achieved with a smaller gelatin coverage in the protective layer, that is, when the silver coverage/swollen thickness ratio is in a specific range. More particularly, as the silver coverage/swollen thickness ratio is increased, dryness improves, but fixation rating lowers. Inversely, as the silver coverage/swollen thickness ratio is decreased, dryness deteriorates, but fixation rating improves. An

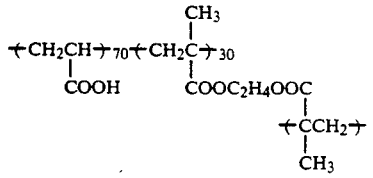

(27)

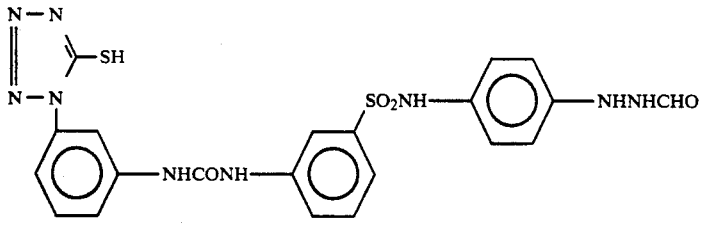

(28)

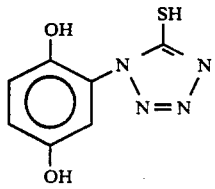

(29)

A protective layer coating composition was prepared as an aqueous gelatin solution containing gelatin, sodium dodecylbenzenesulfonate, silicone fluid, a fluorinated surfactant, colloidal silica, a polyethyl acrylate dispersion, polymethyl methacrylate having a particle size of 2.5 μm as a matte agent, and sodium polystyrenesulfonate as a thickener.

A PET support was concurrently coated with the emulsion to a coating weight corresponding to 3.6 g/m$^2$ of silver and with the protective layer coating composition to a gelatin coverage of 0.7 g/m$^2$.

Using an automatic processor model SRX 501 by Konica K.K., samples of this photosensitive material were processed with a developer and then with a fixer at 38° C., washed, and dried at 50° C. The dry-to-dry processing time was 45 seconds. The developer and fixer used had the following formulations.

| Developer | |
|---|---|
| Hydroquinone | 50.0 g |
| N-methyl-p-aminophenol ½ hydrosulfate | 0.3 g |
| Sodium hydroxide | 18.0 g |
| 5-sulfosalicylic acid | 45.0 g |
| Potassium sulfite | 110.0 g |
| Disodium EDTA | 1.0 g |
| Potassium bromide | 10.0 g |
| 5-methylbenzotriazole | 0.4 g |
| 2-mercaptobenzimidazole-5-sulfonic acid | 0.3 g |
| Sodium 3-(5-mercaptotetrazole)benzene-sulfonate | 0.2 g |
| N-n-butyldiethanolamine | 15.0 g |
| Sodium toluenesulfonate | 8.0 g |
| Water totaling to | 1 liter |
| pH adjusted with KOH to | 11.6 |
| Fixer | gram/liter |
| Ammonium thiosulfate | see Table 5 |
| Meso-ionic compound | see Table 5 |
| Sodium acetate | 15 |
| Sodium sulfite | 9.0 |
| Sodium bisulfite | 15 |
| Disodium EDTA dihydrate | 0.025 |
| pH adjusted with NaOH to | 5.5 |

The processed photosensitive material samples were examined for fixation rate and residual silver as in Example 1.

The results are shown in Table 5.

TABLE 5

| Run No. | Ammonium thiosulfate mol/l (x) | Meso-ionic compound Type | Meso-ionic compound mol/l (Y) | (Y)/(X) | Rating of fixation | Residual Ag, mg/m$^2$ |
|---|---|---|---|---|---|---|
| 1* | 1.25 | — | — | 0 | x x | 180 |
| 2* | 1.25 | 1 | 0.003 | 0.0024 | x x | 175 |
| 3 | 1.25 | 1 | 0.03 | 0.024 | ∘ | 1 |
| 4* | 1.25 | 1 | 0.3 | 0.24 | x | 103 |
| 5* | 1.25 | 5 | 0.003 | 0.0024 | x x | 160 |
| 6 | 1.25 | 5 | 0.03 | 0.024 | ∘ | 2 |
| 7* | 1.25 | 5 | 0.3 | 0.24 | x | 108 |
| 8* | 1.25 | 7 | 0.003 | 0.0024 | x x | 170 |
| 9 | 1.25 | 7 | 0.03 | 0.024 | ∘ | 4 |
| 10* | 1.25 | 7 | 0.3 | 0.24 | x | 95 |
| 11* | 1.25 | 16 | 0.003 | 0.0024 | x x | 165 |
| 12 | 1.25 | 16 | 0.03 | 0.024 | ∘ | 3 |
| 13* | 1.25 | 16 | 0.3 | 0.24 | x | 105 |
| 14* | 2.5 | 1 | 0.03 | 0.012 | x | 85 |
| 15* | 2.5 | 5 | 0.03 | 0.012 | x | 90 |
| 16* | 2.5 | 7 | 0.03 | 0.012 | x | 83 |
| 17* | 2.5 | 16 | 0.03 | 0.012 | x | 77 |

*comparison

It is evident from Table 5 that a fixer within the scope of the invention is suited for rapid processing because of high fixation rating and a minimal amount of residual silver.

EXAMPLE 6

Preparation of Emulsion 6A

An aqueous silver nitrate solution and an aqueous sodium chloride solution containing $5\times10^{-6}$ mol of ammonium rhodium (III) hexachloride $(NH_4)_3RhCl_6$ per mol of silver were concurrently added to an aqueous gelatin solution at pH 3.0 and 40° C. by the double jet technique. There was prepared a monodispersed cubic silver chloride emulsion having a mean grain size of 0.15 μm. After grain formation, 4-hydroxy-6-methyl-1,3,3a,7-tetraazaindene as a stabilizer was added in an amount of $2\times10^{-3}$ mol per mol of silver. The emulsion was conventionally washed with water for removing the soluble salts. After washing, gelatin was added and sodium chloride and sodium hydroxide were added to the emulsion to adjust it at pH 6.0 and pAg 7.6. Then stabilizers, 4-hydroxy-6-methyl-1,3,3a,7-tetraazaindene and 1-phenyl-5-mercaptotetrazole were added in an amount of $5\times10^{-3}$ mol and $4\times10^{-4}$ mol per mol of silver, respectively. The resulting emulsion 6A contained 110 grams of silver and 55 grams of gelatin per kilogram.

A coating composition for forming a silver halide emulsion U layer was prepared by adding 120 mg/m$^2$ of a compound of formula (30), 40 mg/m$^2$ of a hydrazine compound of formula (31), 300 mg/m$^2$ of the latex described in Exemplary Formulation 3 of U.S. Pat. No. 3,525,620 as a polymer latex, and 100 mg/m$^2$ of 1,3-divinylsulfonyl-2-propanol as a hardener to emulsion 6A, all expressed in coating weight per square meter of support.

(30)

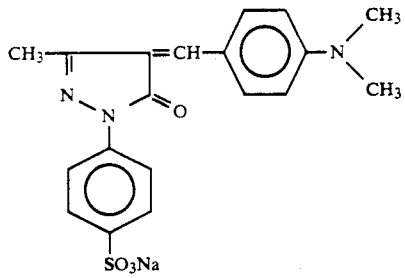

(31)

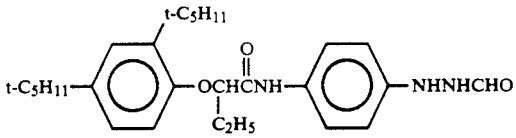

Preparation of Emulsion 6B

By following the same procedure as above, there was prepared emulsion 6B containing $1.2\times10^{-5}$ mol of ammonium rhodium (III) hexachloride per mol of silver.

A coating composition for forming a silver halide emulsion O layer was prepared by adding 80 mg/m$^2$ of a compound of formula (32), 25 mg/m$^2$ of a compound of formula (33), 200 mg/m$^2$ of the latex described in Exemplary Formulation 3 of U.S. Pat. No. 3,525,620 as a polymer latex, and 50 mg/m$^2$ of 1,3-divinylsulfonyl-2-propanol as a hardener to emulsion 6B, all expressed in coating weight per square meter of support.

(32)

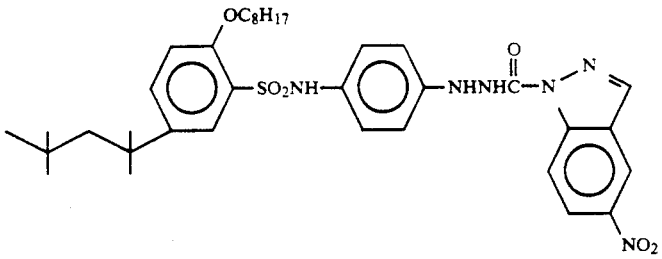

(33)

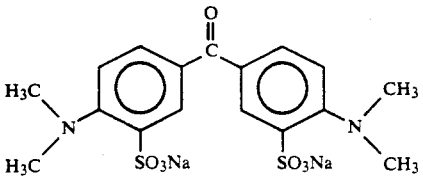

Preparation of Photosensitive Material

A protective layer coating composition was prepared by adding 40 mg/m$^2$ of an amorphous silica matte agent having a mean particle size of about 3.0 μm, 100 mg/m$^2$ of polyacrylamide, 40 mg/m$^2$ of sodium p-dodecylbenzenesulfonate, and 10 mg/m$^2$ of $C_8F_{17}SO_3N(C_3H_7)CH_2COOK$ as a fluorinated surfactant to a gelatin solution, all expressed in coating weight per square meter of support.

A PET film support of 100 μm thick was coated with the silver halide emulsion U layer-coating composition (based on emulsion 6A) to a coating weight of 3.0 g/m$^2$ of silver, with gelatin thereon to a coating weight of 0.5 g/m$^2$ of gelatin, with the silver halide emulsion O layer-coating composition (based on emulsion 6B) thereon to a coating weight of 0.3 g/m$^2$ of silver, and finally with the protective layer coating composition as a topcoat to a coating weight of 0.5 g/m$^2$ of gelatin.

Using an automatic processor model FG-710NH (Fuji Photo-Film Co., Ltd.), the photosensitive material sample without exposure was processed with a developer at 38° C. and with a fixer at 37° C. on a dry-to-dry basis of 45 seconds.

The developer used was the same as in Example 5 and the fixer used was the same as in Example 5 except that the concentration of ammonium thiosulfate and the type and concentration of the meso-ionic compound were as reported in Table 6.

The results are shown in Table 6.

TABLE 6

| Run No. | Ammonium thiosulfate mol/l (x) | Meso-ionic compound Type | Meso-ionic compound mol/l (Y) | (Y)/(X) | Rating of fixation | Residual Ag, mg/m$^2$ |
|---|---|---|---|---|---|---|
| 1* | 1.0 | — | — | 0 | x x | 155 |
| 2* | 1.0 | 3 | 0.002 | 0.002 | x x | 170 |
| 3 | 1.0 | 3 | 0.03 | 0.03 | ○ | 0 |
| 4* | 1.0 | 3 | 0.4 | 0.4 | x | 108 |
| 5* | 1.0 | 6 | 0.002 | 0.002 | x x | 140 |
| 6 | 1.0 | 6 | 0.03 | 0.03 | ○ | 2 |
| 7* | 1.0 | 6 | 0.4 | 0.4 | x | 120 |
| 8* | 1.0 | 12 | 0.002 | 0.002 | x x | 170 |
| 9 | 1.0 | 12 | 0.03 | 0.03 | ○ | 1 |
| 10* | 1.0 | 12 | 0.4 | 0.4 | x | 105 |
| 11* | 1.0 | 18 | 0.002 | 0.002 | x x | 160 |
| 12 | 1.0 | 18 | 0.03 | 0.03 | ○ | 3 |

TABLE 6-continued

| Run No. | Ammonium thiosulfate mol/l (x) | Meso-ionic compound Type | Meso-ionic compound mol/l (Y) | (Y)/(X) | Rating of fixation | Residual Ag, mg/m² |
|---|---|---|---|---|---|---|
| 13* | 1.0 | 18 | 0.4 | 0.4 | x | 120 |

*comparison

It is evident from Table 6 that better fixation ratings are achieved with fixers containing a meso-ionic compound in combination with ammonium thiosulfate within the scope of the invention.

There has been described a fixer containing a meso-ionic compound and a thiosulfate in specific relative concentrations which is adapted for rapid fixation.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for processing an imagewise exposed silver halide black-and-white photosensitive material, comprising the steps of developing in a developing solution and fixing in a fixer solution, the fixer solution containing 0.5 to 2.0 mol/liter of a thiosulfate and 0.003 to 0.3 mol/liter of a meso-ionic compound of general formula (I):

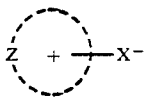

(I)

wherein Z is a five or six-membered ring composed of atoms selected from the group consisting of carbon, nitrogen, oxygen, sulfur, and selenium atoms, and $X^-$ is $—O^-$, $—S^-$ or $—NR^-$, wherein R is selected from the group consisting of an alkyl, cycloalkyl, alkenyl, alkynyl, aralkyl, aryl, and heterocyclic group, the moles of the compound of formula (I) divided by the moles of the thiosulfate being from 0.003 to 0.2.

2. The method of claim 1 wherein the processing is carried out for a fixing time of up to 19 seconds by means of an automatic processor and the coverage of silver on the photosensitive material (expressed in $g/m^2$) divided by the swollen thickness (expressed in μm) is from 0.6 to 1.5.

3. The method of claim 1 wherein the processing is carried out for a fixing time of up to 19 seconds by means of an automatic processor including a fixing tank having 3 to 10 pairs of opposed rollers, the fixer is circulated through the fixing tank at a flow velocity of 50 to 200 m/min., the volume of the fixer circulated per minute ranges from 70 to 200% of the volume of the fixing tank, and the photosensitive material is passed through the processor at a line speed of at least 15 mm/sec.

4. The method of claim 2 wherein the photosensitive material includes a protective layer disposed adjacent a photosensitive emulsion, said protective layer containing 0.2 to 1.0 $g/m^2$ of gelatin.

5. The method of claim 1 wherein the processing is carried out by means of an automatic processor and the fixer has pH 5.3 to 7.0 and contains 0 to 0.01 mol/liter of a water-soluble aluminum compound.

6. The method of claim 1 wherein the processing is carried out for a fixing time of up to 10 seconds by means of an automatic processor.

7. The method of claim 1 wherein the mols of the compound of formula (I) divided by the mols of the thiosulfate is from 0.01 to 0.15.

8. A fixer for use in the processing of silver halide black-and-white photosensitive material, which contains 0.5 to 2.0 mol/liter of a thiosulfate and 0.003 to 0.3 mol/liter of a meso-ionic compound of general formula (I):

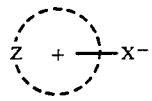

(I)

wherein Z is a five or six-membered ring composed of atoms selected from the group consisting of carbon, nitrogen, oxygen, sulfur, and selenium atoms, and $X^-$ is $—O^-$, $—S^-$ or $—NR^-$, wherein R is selected from the group consisting of an alkyl, cycloalkyl, alkenyl, alkynyl, aralkyl, aryl, and heterocyclic group, the moles of the compound of formula (I) divided by the moles of the thiosulfate being from 0.003 to 0.2.

9. The fixer of claim 8 which contains 0 to 0.01 mol/liter of a water-soluble aluminum compound and is at pH 5.3 to 7.0.

10. The fixer of claim 8 wherein the mols of the compound of formula (I) divided by the mols of the thiosulfate is from 0.01 to 0.15.

* * * * *